US006371788B1

(12) United States Patent
Bowling et al.

(10) Patent No.: US 6,371,788 B1
(45) Date of Patent: Apr. 16, 2002

(54) WAFER CONNECTION LATCHING ASSEMBLY

(75) Inventors: Paul Bowling, Little Rock; Keith Lloyd, Maumelle, both of AR (US); Michael F. Magajne, Cicero; Kent E. Regnier, Lombard, both of IL (US); Ed Seamands, Little Rock, AR (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/575,098

(22) Filed: May 19, 2000

(51) Int. Cl.[7] ..... H01R 13/627
(52) U.S. Cl. ..... 439/358; 439/701
(58) Field of Search ..... 439/350, 351, 439/352, 355, 357, 358, 701, 607

(56) References Cited

U.S. PATENT DOCUMENTS

| | | | | | |
|---|---|---|---|---|---|
| 4,615,578 | A | | 10/1986 | Stadler et al. | 339/143 |
| 5,011,425 | A | * | 4/1991 | Van Zanten et al. | 439/358 |
| 5,176,538 | A | | 1/1993 | Hansell, III et al. | 439/607 |
| 5,281,161 | A | * | 1/1994 | Kanai | 439/357 |
| 5,879,194 | A | * | 3/1999 | Thenaisie et al. | 439/607 |
| 5,993,259 | A | | 11/1999 | Stokoe et al. | 439/608 |
| 5,997,361 | A | * | 12/1999 | Driscoll et al. | 439/701 |
| 6,056,578 | A | * | 5/2000 | Lin | 439/358 |
| 6,120,332 | A | * | 9/2000 | Bertens et al. | 439/701 |

* cited by examiner

*Primary Examiner*—Hien Vu
(74) *Attorney, Agent, or Firm*—Thomas D. Paulius; A. A. Tirva

(57) ABSTRACT

Blocks of wafer or plug connectors are held together by retainer members and are secured within a backplane connector by a latching assembly. The latching assembly includes a latching lever that has an engagement end extending to the base of the backplane connector. The lever is movably connected to the retainer member so that it may pivot, or rock, about an inflection point. The lever also includes a biasing member that constantly biases the lever into a latching position.

13 Claims, 5 Drawing Sheets

WAFER CONNECTION LATCHING ASSEMBLY

BACKGROUND OF THE INVENTION

The present invention relates generally to backplane connector assemblies, and more particularly to a latching assembly that holds a series of wafer connectors in place within a backplane connector.

Backplane connectors provide receptacles for circuit boards that receive other connectors. In the field of telecommunications, it is common for such connectors to include thin connectors that receive coaxial wires and provide connections between two to four of the wires to a circuit board. These connectors are thin and are often referred to in the art as "wafer" connectors because of their relative diminutive size. In order to facilitate the assembly of such connectors into a suitable backplane connector, it is desirable to hold the connectors together in the form of a block, or other unit. Retainers and clips have been used in the art to accomplish this end. In some applications, it is also desirable to hold the blocks of wafer connectors together in engagement with the backplane connector. It is desirable to provide such a means to hold the connectors in place in the backplane connector and it is further desirable that such a means be easily manipulated with one hand and actuatable without the need to see the points of engagement.

One such connector latching means is described in U.S. Pat. No. 5,186,645, issued Feb. 16, 1993 to the assignee of the present invention. In this patent, an elongated latching member extends alongside a backplane connector and is attached to the circuit board. This attachment to the circuit board uses valuable space on the circuit board that could otherwise be used for circuitry. Additionally, it has a series of latching arms that partially extend over the receptacle portion of the backplane connector. Consequently, the wafer connectors must be moved about in insertion and withdrawal so that the engagement with the latching arm of the latching member is released. It is difficult to utilize such a latching system in tight spaces and it does not facilitate the one-handed insertion and removal of the connector units.

Another latching system is described in U.S. Pat. No. 5,312,276, issued May 17, 1994 wherein a pin header is provided with a pair of lugs. A latch member is provided that engages a connector unit and which also engages the pin header. The latch member is snapped into engagement with the connector unit. The latch member is a separate element and may be prone to loss and misengagement in tight spaces.

The present invention is directed to a backplane connector latching assembly that overcomes the aforementioned disadvantages.

SUMMARY OF THE INVENTION

It is therefore a general object of the present invention to provide an active latching system that is usable on pin headers and other backplane connectors and which does not consume valuable space on a supporting circuit board.

It is another object of the present invention to provide a latching assembly for use with wafer and backplane connectors having a latch member of a low profile that may be used in high density applications.

A further object of the present invention is to provide a latching assembly for backplane connectors in which the assembly includes a retainer member that engages and holds a plurality of wafer connectors together as a block, a latching member that is movably mounted to the retainer and which has a latching end and an actuating end, the latching member extending over and alongside the sidewalls of the backplane connector, whereby the latching member may be easily manipulated into and out of engagement with the backplane connector.

Still another object of the present invention is to provide a latching assembly for use with a backplane connector that receives a plurality of individual wafer connectors therein, the latching assembly including an elongated latching member having a structure sufficient to be used on as little as two of the wafer connectors, the latching member having means for spacing the latching member from the wafer connectors and for permitting selective movement of the latching member, the latching member further having an engagement end that opposes the base of a backplane connector and an actuating end opposite that of the engagement end, the actuating end being movable in two directions either to engage the latching member with the backplane connector or to disengage the latching member from the backplane member.

Yet another object of the present invention is to provide a latch for use with a plurality of wafer connectors to hold the connectors in place within a backplane connector, the latch having an elongated body with two free ends and a contact portion intermediate the two ends, the contact portion abutting the wafer connectors and defining a fulcrum about which the latch can move in a pivotal motion so as to move the latch into and out of engagement with the backplane connector.

A still further object of the present invention is to provide a connector latching assembly including a plurality of connector bodies that are held together as a unit by one or more retainers that extend lengthwise along the unit of connectors, a latch member having an engagement end and an actuating end that extend vertically alongside the connectors, means for movably connecting the latch to the retainer intermediate the two ends, the engagement end having a hook portion disposed thereon and being engageable with the bottom of the backplane connector, the actuating end being easily manipulatable by a connector installer, the latch member being movable about the connecting means so that a user may selectively manipulate the latch engagement end into and out of engagement with the backplane connector.

Yet a further object of the present invention is to provide an active connector latching assembly for latching a series of wafer connectors in place to a backplane connector, wherein the latching assembly includes a pair of low profile latching levers that are movably attached to a pair of retainers that engage the sides of the connectors. The latching levers including biasing members that bias the levers into an engagement position, and the levers having manipulatable end portions that release the levers from engagement when manipulated by a user.

The present invention accomplishes these objects by way of its novel and unique structure. As demonstrated in one embodiment, the latching assembly includes an elongated latching member that has a length greater than the height of a corresponding stack of wafer connectors. The latching member has a width that matches the width of at least two wafer connectors of the connector stock. The latching member includes a bearing surface that abuts the connector stack. This bearing surface is pronounced and defines a point about which the latching member selectively rocks or moves under pressure by the installer. The latching assembly also includes means for attaching the latching member to the connectors. This attachment occurs along the bearing surface and enables the latching member to move about its point of attachment.

One end of the latching member is provided with a hook end that is adapted to engage a backplane header. Preferably, this engagement occurs along the underside of the backplane connector. The other end of the latching member includes a manipulatable portion which an installer of the connectors can use to move the hook ends in and out of engagement with the backplane connector. The latching member also includes a biasing member that exerts a biasing force on the lever so as to urge the hook ends toward an engagement position with the backplane connector.

The latching assembly may include a retainer member that engages the wafer connectors and holds them together as a block, or unit, of connectors. This retainer member runs lengthwise of the connectors, and it may have openings formed therein that receive attachment lugs that fit in the openings and attach the latching members to the retainers in a manner so as to permit the latching member to rock or pivot around it. In this embodiment, the latching member bearing surface is provided by a protrusion formed therein that projects toward the retainer member. This protrusion spaces the latching member away from the connectors which enables the rocking movement of the latching member. The protrusion has a low profile so that the latching member is spaced only a short distance apart from the connector block so that the latching assembly may be used on high density circuit board applications.

In another principal aspect of the present invention and as exemplified by a second embodiment thereof, the retainer members may be formed with a raised, curved backbone portion that extends away from the connectors, while the latching member bearing surface is flat. In this embodiment, the latching member attachment means may be formed integrally with the latching member in the form of arms or lugs that are received within openings in the retainers.

In yet another principal aspect of the present invention, the retainer member may include a pair of catches that are spaced apart from each other to define a slot that receives a latching member. The latching member manipulation end is folded back upon itself to provide an activating end that can be actuated by pressing it. A pin is held by the catches to provide a surface to keep the latching member in place.

These and other objects, features and advantages of the present invention will be clearly understood through consideration of the following detailed description.

BRIEF DESCRIPTION OF THE DRAWINGS

In the course of the following detailed description reference will be frequently made to the accompanying drawings in which.

DESCRIPTION OF THE PREFERRED EMBODIMENT

Figure 1:
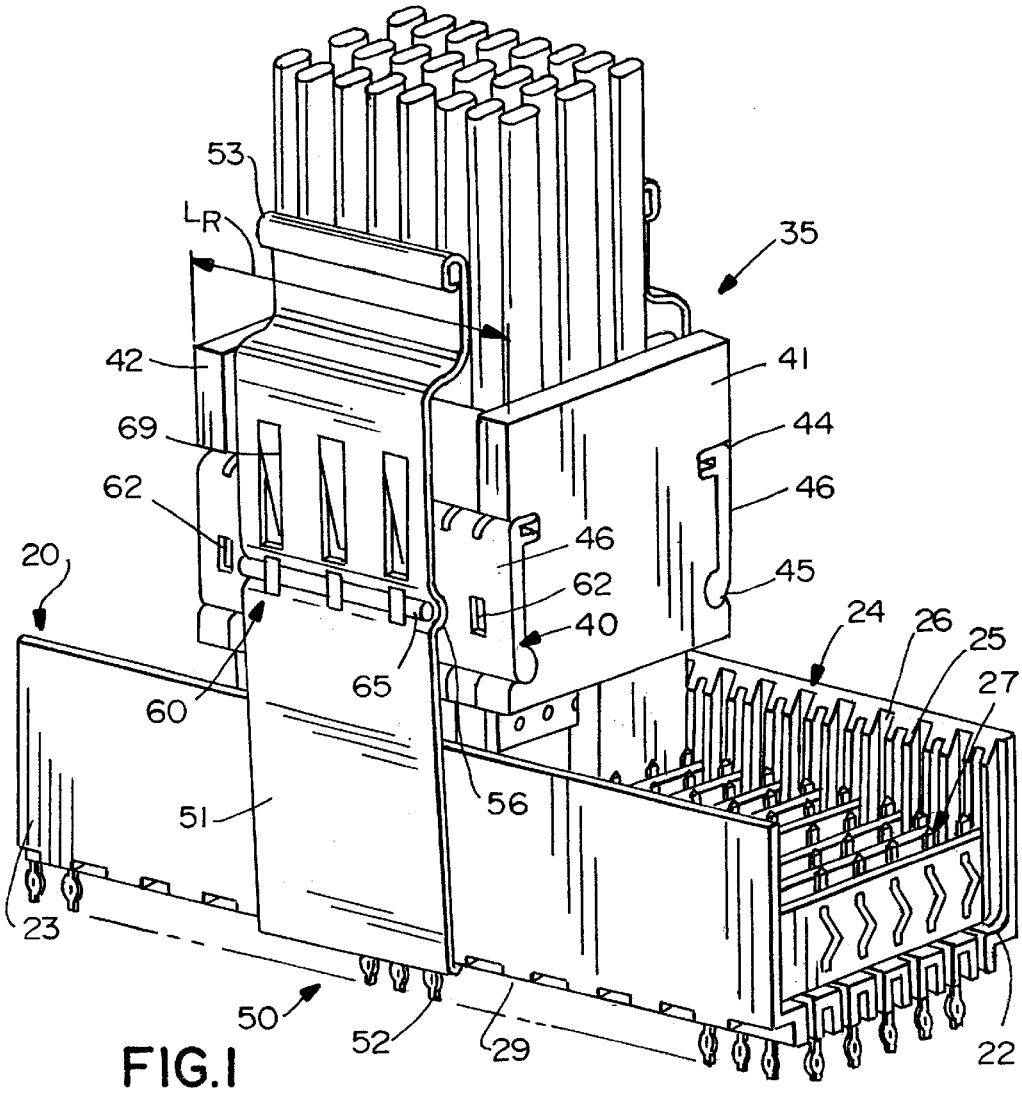
FIG. 1 is a perspective view of a connector latching assembly constructed in accordance with the principles of the present invention in place on a stack of wafer connectors and engaging a backplane connector.

FIG. 1 illustrates a suitable application for the latching assemblies of the present invention. A backplane connector 20 is illustrated as having a generally channel-shaped configuration, with a base portion 22 and a pair to upstanding sidewalls 23, 24. The sidewalls 23, 24 may include a series of ribs 25 that define slots 26 therebetween which may receive opposing alignment ribs 25 (FIG. 5) that are formed on the connectors 30.

Figure 2:
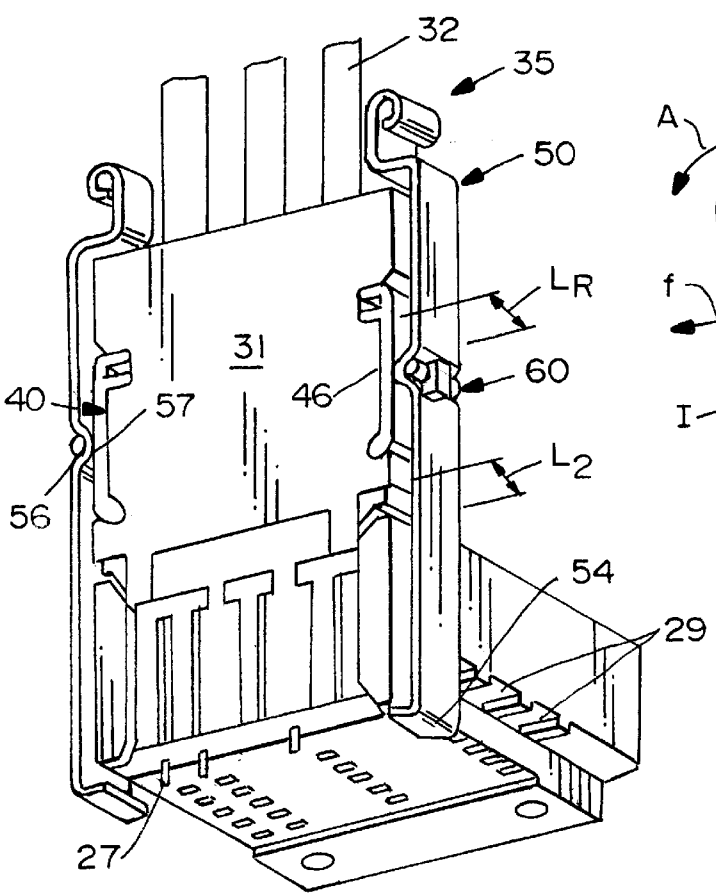
FIG. 2 is a perspective view of the underside of a stack of two wafer connectors engaged with a backplane connector with a reduced-size version of the connector latching assembly of FIG. 1.

The backplane connector 20 provides a means of connecting a series of connectors 30, shown as wafer connectors, to a circuit board (not shown), and therefore is provided with a plurality of conductive pins 27 therein. Hence, the backplane connector 20 may be referred to as a pin header. Each connector 30 has a relatively thin body portion 31 (FIGS. 2–4) into which wires 32 enter and are terminated to either conductive terminals or shields (not shown) that are accessible to the pins 27 of the backplane connector 20. Accordingly, the connecting ends 33 of the connectors 30 are provided with openings 34 (FIG. 5) that define passages in which the pins 27 are received when the connectors 30 are inserted into the backplane connector 20.

In order to facilitate the installation and removal of these connectors, it is desirable to hold them together as a block 35, unit or stack of connectors. To achieve this goal, one or more retainer members or connector stiffeners 40 may be provided. The structure and operation of such a retainer is described in detail in U.S. patent application Ser. No. 09/515,133, filed Feb. 29, 2000, and owned by the assignee of the present invention. The disclosure of this patent application is incorporated herein by reference.

Generally, each retainer member 40 has a length $L_R$ that is approximately equal to the length of the connector block. (FIG. 1.), it being understood that the connector block 35, as illustrated in FIG. 1 may include a pair of endcaps 41, 42 that may will serve as spacers between adjoining blocks of connectors 30. The retainer members 40 have two ends 44, 45 that are interconnected by a backbone or body portion 46. The ends 44, 45, as explained in the aforementioned application Ser. No. 09/515,133, serve to connect the retainer member 40 to the individual connectors 30 and hold them together as a block or unit of connectors as shown in the drawings. The retainer member 40 therefore has a length that matches that of the connector block 35 and in instances such as that shown in FIG. 1 may have a length $L_R$ that encompasses the connectors and as the endcaps 41, 42, or it may have a length $L_2$ that is just about equal to the length of the connectors 30 that make up the connector block 35, such as the two connectors depicted in FIG. 2.

As mentioned above, the present invention is directed toward a latching assembly that is easy to use and which reliably retains the block of connectors 30 in place within the backplane connector 20. As shown in FIG. 1, one embodiment of the latching assembly includes a latching member 50 in having an elongated body portion that defines a lever 51. This latching lever 51 has two opposing ends, 52, 53. One of the ends 52 acts as a latching end of the lever 51 and has an engagement portion formed thereon that is illustrated as a hook 54. The other end 53 acts as an actuating end that is manipulatable by a user, or installer of the connectors 30 to move the latching lever 51 into and out of engagement with the backplane connector 20. This actuating end 53 may include gripping portions 55 to accommodate the installer's fingers.

The latching lever 51 is intended to move, or rock, in place around a fixed point I, referred to herein as an inflection point. This movement is generally characterized as a rocking movement and may in some instances be a pivoting movement. This movement is shown best in FIGS. 3 and 4 which respectively illustrate the latching lever 51 in a latched (or engaged) position and an unlatched (or disengaged) position. In the latched position, it can be seen that the hook ends 54 engage the backplane connector base 22. The backplane connector base 22 may or may not include channels, or slots, 29 formed therein that are adapted to receive the hook ends 54. In order to accommodate this latching movement, the latching lever 51 of this first embodiment includes a protrusion 56 formed thereon that preferably includes a curved contact surface 57 that faces the retainer member 40. The latching lever 51 rocks on this contact, or bearing, surface 57 in its movement between the two operative positions illustrated in FIGS. 3 and 4.

Figure 11:
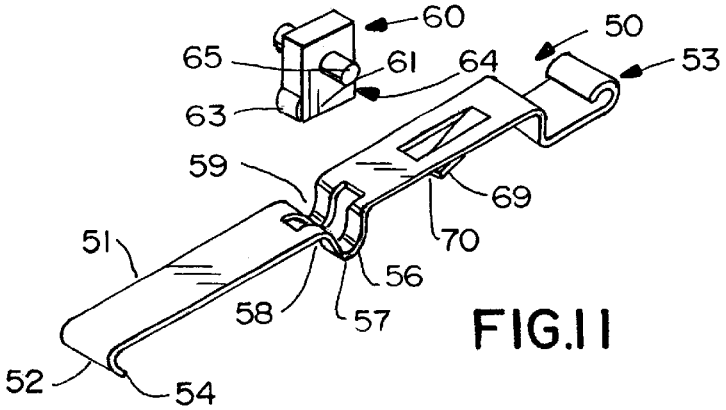
FIG. 11 is an exploded view of the latching assembly of FIG. 1.

The latching assembly also includes a means for attaching the latching lever 51 to the connector block. This attachment means in the first embodiment may take the form of a clip 60 as illustrated best in FIGS. 1, 2 and 11. As shown in FIG. 11, this clip 60 includes an engagement lug 61 that extends through an opening 58 formed in the latching lever 51 at the inflection point I and is received within a similar opening 62 that is formed in the retainer member 40. The lug 61 may have an enlarged portion 63 at its engagement end 64 to retain it in the retainer opening 62. The retainer member 40 may have a series of such openings 62 formed in it along its length that receive corresponding individual clips 60 as shown in FIG. 1.

The latching lever 51 has a hollow depression 59 formed thereon in the exterior surface of the lever 51 in alignment with the protrusion 56. This depression 59 partially holds the clip 60 in that it preferably receives a pin member 65 of the clip 60 that extends lengthwise alongside of the connector block. As shown in FIG. 11, the pin 65 is received within the depression 59 of the latching lever 51 and provides a rotational guide that guides and permits the desirable rocking movement of the lever 51.

Figure 3:
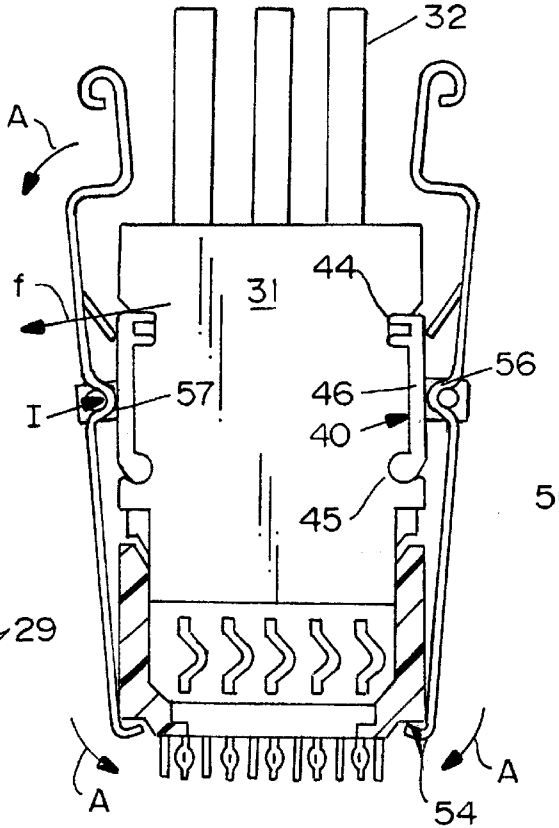
FIG. 3 is a sectional view illustrating the manner of engagement between the latching assembly and the backplane connector with the latching assembly illustrated in a latching position.

In order to bias the latching lever 51 into one of its two operative positions, the latching lever 51 may include a biasing member, shown In FIGS. 1–4 and 11 as a biasing arm 69, that may be formed integrally with the lever 51. This biasing arm 69 extends from the lever 51 toward the connector block 35. It extends in an angled, cantilevered fashion and has a free end 70 that bears against either the connector block 35 or the retainer member 40. As shown in FIG. 3, this biasing arm is located above the inflection point I and therefore exerts an outward force F on the latching lever 51. However because the lever 51 is connected to the connector block 35 at the retainer member 40 by way of the clip 60, the entire lever 51 is restrained from moving apart from the connector block 35. Rather, the clip pin 65 and the lever contact surface 57 cooperate to permit the lever to partially rotate, counterclockwise in FIG. 3, as shown by the arrows A in a manner so as to bias the hook ends 54 of the lever 51 into engagement with the backplane connector base 22. The direction and result of this biasing is shown by the arrows A in FIG. 3.

Figure 4:
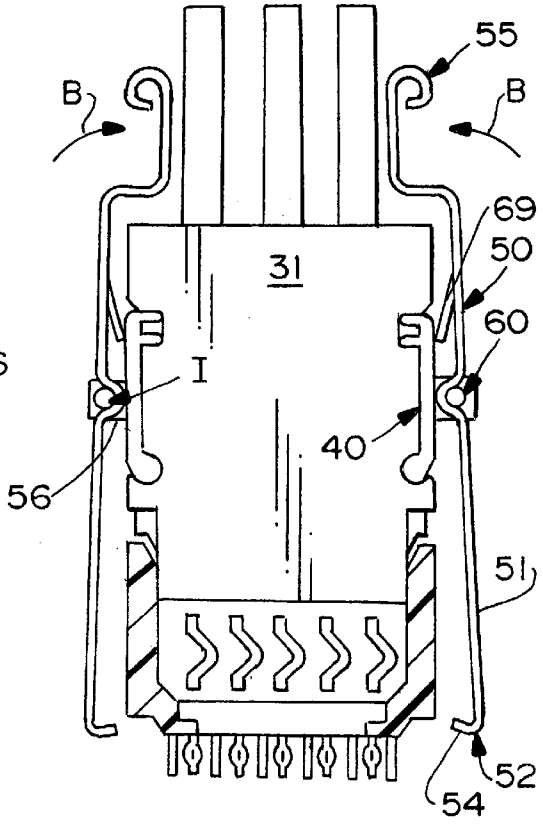
FIG. 4 is the same view as FIG. 3, but illustrating the latching assembly in an unlatched position.

In order to counteract this biasing force, the installer may apply an inward force, represented by the arrows B in FIG. 4. The application of this force will cause the levers 51 to rotate clockwise to disengage the hook ends 54 from the backplane connector base 22. Once removed, the biasing arms 69 will cause the levers 51 to rotate inwardly again. Thus it will be appreciated that the biasing arms 69 serve to maintain the levers 51 in a latched position so that the installer need not be concerned about a proper engagement. Additionally, the hook ends 54 may slide along the exterior surfaces of the backplane sidewalls 23, 24 during insertion of the connector block 35 into the connector 20. The biasing force exerted on the lever 51 will cause the hook ends 54 to snap into engagement with a slot 29 formed in the bottom surface of the connector base 22.

Figure 5:
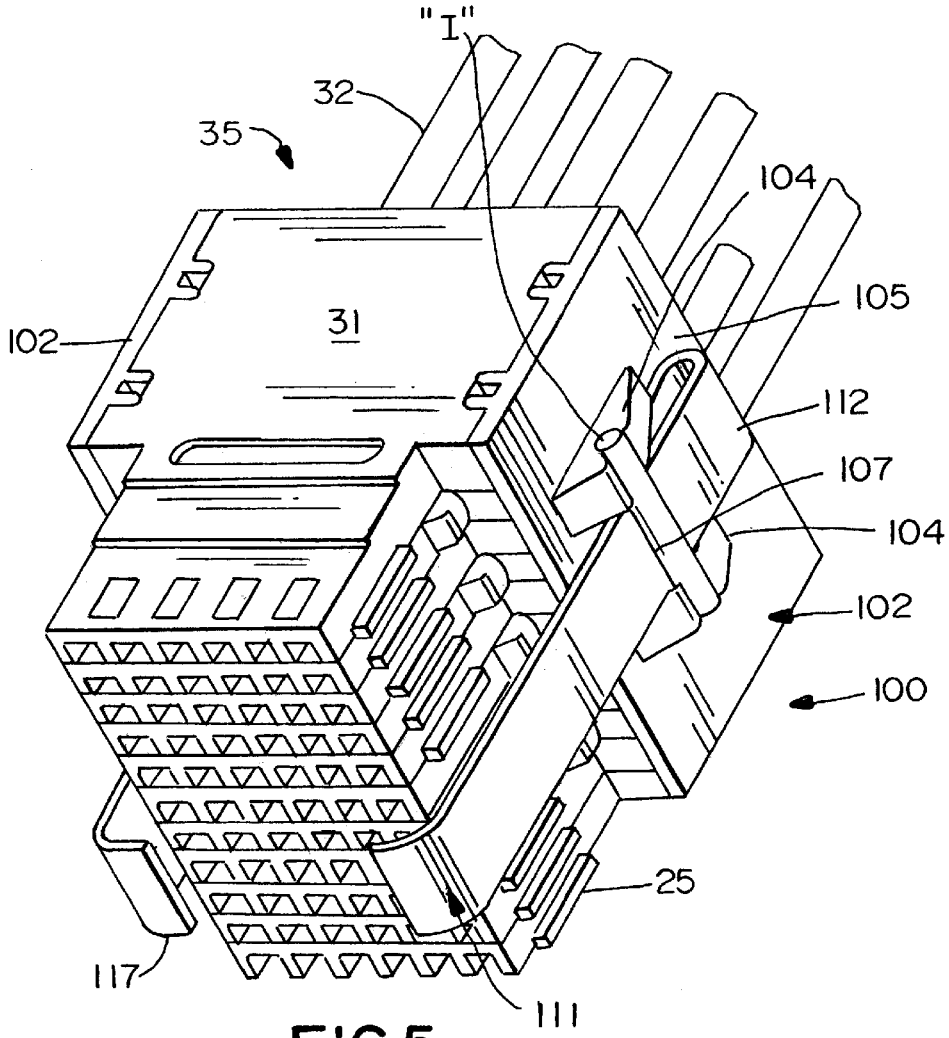
FIG. 5 is a perspective view taken from the-underside of a group of connectors, illustrating a second embodiment of a connector latching assembly constructed in accordance with the principles of the present invention in place on a stack of connectors.
Figure 6:
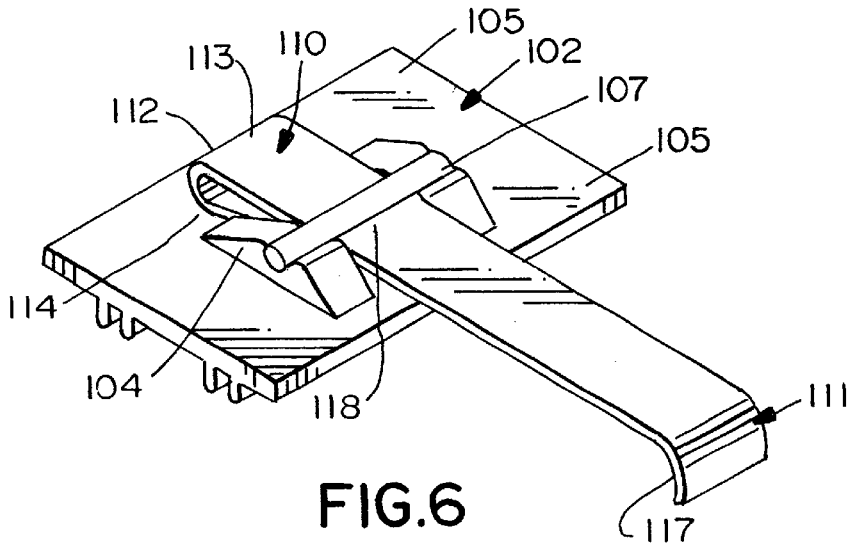
FIG. 6 is a perspective view of the latching assembly of FIG. 5.
Figure 7:
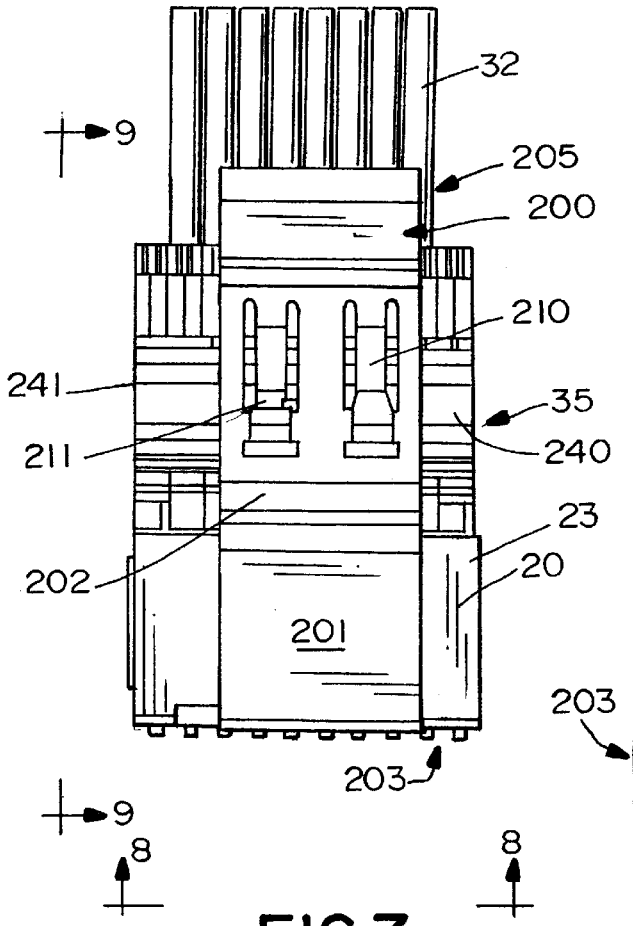
FIG. 7 is a side elevational view of a third embodiment of a latching assembly constructed in accordance with the principles of the present invention in place upon a stack of connectors and holding them in place with a backplane connector.
Figure 8:
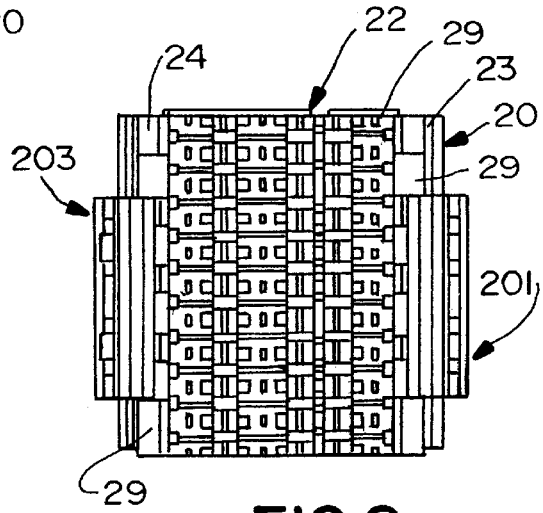
FIG. 8 is a bottom plan view of the connector assembly of FIG. 7 taken from along lines 8—8 thereof.
Figure 9:
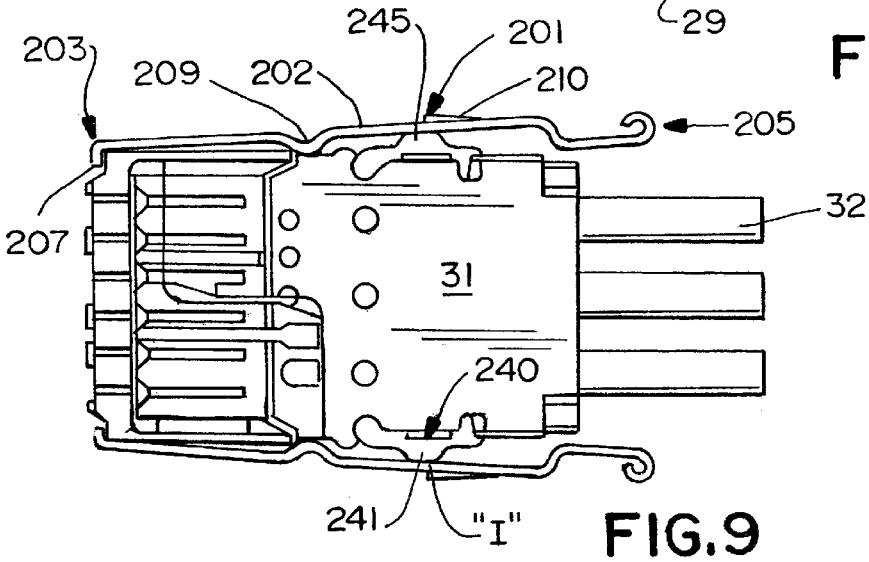
FIG. 9 is an end view of the connector assembly of FIG. 7 taken along lines 9—9 thereof.
Figure 10:
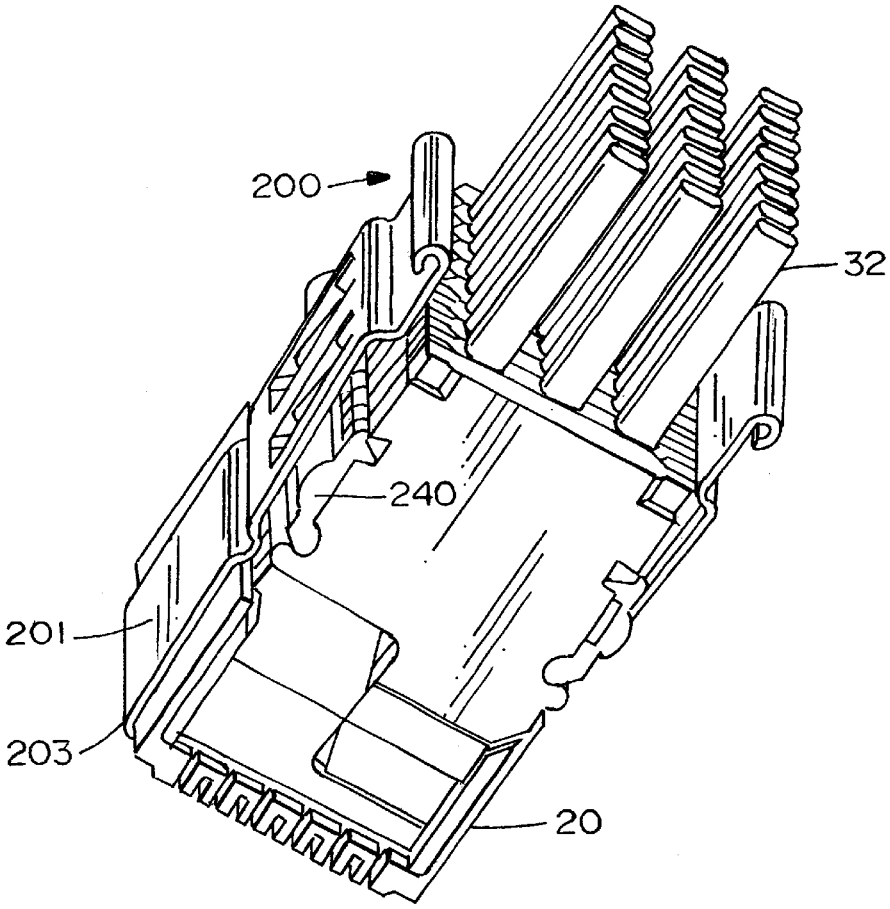
FIG. 10 is a perspective view of the connector assembly of FIG. 7.
Figure 12:
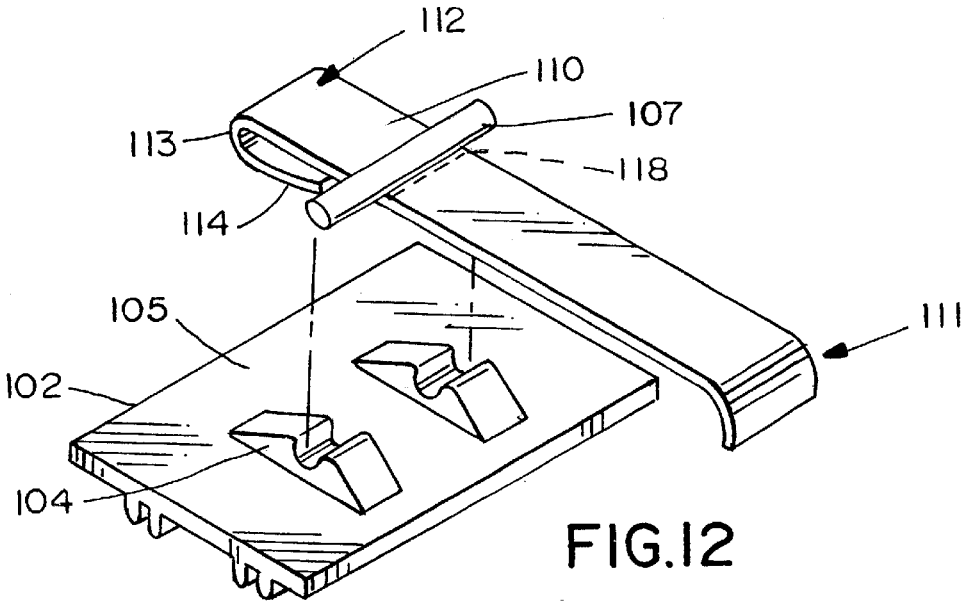
FIG. 12 is an exploded view of the latching assembly of FIG. 5.

FIGS. 5 and 12 illustrate a second embodiment of a latching assembly 100 constructed in accordance with the principles of the present invention. In this latching assembly 100, the retainer member 102 is much larger than the one of FIGS. 1–4 and it has a pair of support blocks 104 formed therewith. The latching lever 110 is much simpler having a lower hook end 111 and an upper biasing end 112. This biasing end 112 is formed by way of a flexible end 113 that is bent upon itself so that a free end 114 thereof abuttingly contacts the outer surface 105 of the retainer 102.

The support blocks 104 are spaced apart from each other a distance sufficient to accommodate the latching lever 110 therebetween. A pin 107 is provided and may be held in the support blocks 104 in the manner show to restrain the latching lever 110 to partial pivotal or rocking movement. The pin 107 may also be formed as part of the latching lever 110 as well. In instances where the pin is separate, the latching lever may include a recess 118 that extends transversely thereacross in order to locate the lever 110 at a predetermined location with respect to the engagement end 117 of the lever 110.

FIGS. 7–10 illustrate another embodiment 200 of the latching assembly constructed in accordance with the principles of the present invention. In this embodiment, the latching lever 201 is slightly modified in that it has no protrusion comparable to that in the first embodiment. In this embodiment, the retainer member 240 has a protrusion, or projection 241 that in effect serves as a fulcrum about which the lever 201 may move. This projection 241 also serves to space the lever 201 away from the sides of the connector block 35.

The lever 201 has an elongated body portion 202 with opposing engagement ends 203 and actuating ends 205. The actuating ends 205 have gripping portions 206 on them, while the engagement ends 203 may include hook portions 207 that are adapted to engage channels 29 formed in the base 22 of the backplane connector 20. The lever 201 may also include a stop portion 209 that projects toward the connector block 35 that will limit the inward movement. The stop portion 209 is disposed between the point of connection between (and inflection) I of the lever 201 and the connector block 35.

These type levers 201 have their biasing portion integrated into their structure in the form of an attachment leg 210 that extends inwardly therefrom in a cantilevered fashion. This leg 210 has a free end 211 that is received within an opening 242 formed in the body of the retainer 240. This leg 210 preferably diverges at an angle from the body of the lever 201 directed toward the connector block 35 and the connection end thereof. The leg free end 211 is inserted into the retainer opening and the angle of the leg imparts an inward, or counter-clockwise bias to the lever 201 forcing the two levers 201 on a connector block 35 toward each other and toward the center of the backplane connectors 20 to thereby engage the backplane connector 20 along its base portion 22.

Thus, the biasing elements of the latching lever 201 continuously bias the engagement ends 203 into an engagement position. In order to disengage the latching lever 201 from the backplane connector 20, a user need only exert pressure in a direction opposite that of the biasing elements, or inwardly to thereby rotate the latching levers 201 around the exterior bearing surface 245 of the retainer projections 241. It can be seen that such a structure is a user-friendly "active" latch, i.e., the latching levers are always biased into positions.

The latching levers of the present invention also have a thin and low profile in that they do not project excessively from the connector block so that the latching assembly may be easily used in high density circuit board applications. Additionally, because the latching levers are attached to the connector block 35 along the retainers thereof, it does not require any modification to the body portions of the wafer connectors. Furthermore, it may be used on as few as two connectors.

While the preferred embodiment of the invention have been shown and described, it will be apparent to those skilled in the art that changes and modifications may be made therein without departing from the spirit of the invention, the scope of which is defined by the appended claims.

We claim:

1. A latching assembly for securing a plurality of connector modules to a mating connector in mating engagement, comprising:

a latching lever for mounting to the plurality of connector modules, the latching lever having an elongated body portion extending between two opposing ends, a first of the two ends being a latching end that is disposed in opposition to said mating connector where said latching lever is mounted to said plurality of connector modules, a second of said two ends being an activating end that is manipulatable by a user to urge said first end into and out of engagement of said mating connector;

a retainer member that engages said plurality of connector modules and holds said connector modules together as a block of connectors;

means for movably mounting said latching lever to said plurality of modules at a point of inflection intermediate said two ends, said movable mounting means being a separate component and including a clip member that movably attaches said latching lever to said retainer member; and a biasing member for applying a biasing force to said latching lever to constantly urge said latching lever into an engagement position.

2. The latching assembly of claim 1, wherein said biasing member is disposed on said latching lever between said inflection point and said latching lever second end.

3. The latching assembly of claim 1, wherein said biasing member includes a leg portion that is formed as part of said latching lever, said leg portion extending at an angle from said latching lever into contact with said retainer member.

4. The latching assembly of claim 1, wherein said latching lever is spaced apart slightly from said plurality of connectors and extends alongside thereof in a low profile such that said latching lever does not interfere with adjacent connectors.

5. The latching assembly of claim 1 wherein said latching lever includes a curved bearing surface formed thereon that contacts said retainer member and defines an inflection point about which said latching lever can move, said latching lever including an opening disposed therein along said bearing surface and wherein said clip member extends through said latching lever opening and into engagement with said retainer member, the clip member permitting said latching lever to rotate about said inflection point.

6. The latching assembly of claim 5, wherein said clip member includes a cylindrical pin portion that extends transversely to said latching lever, said pin portion being received within a depression formed in said latching lever.

7. The latching assembly of claim 5, wherein said clip member includes a cylindrical pin portion that extends transversely to said curved bearing surface, said pin portion being received within a depression formed in said latching lever.

8. A latchable electrical connector assembly for insertion into a backplane connector, the backplane connector having a channel portion formed by a base and two sidewalls, a plurality of conductive pins disposed in the backplane connector, the connector assembly comprising:

a plurality of wafer connectors, each of the wafer connectors having a body portion that is selectively partially insertable into and removable from mating engagement with said conductive pins of said backplane connector, said wafer connectors being held together as a block by at least one retainer member extending alongside said connector body portions, the retainer member engaging said connector body portions so as to retain said connectors together as a block of connectors, at least one latching lever having an elongated body portion, the latching lever having two opposing ends, one of said two ends including an engagement end for engaging said backplane connector base, the other of said two ends including an actuating end with a gripping portion for a user to actuate said latching assembly between respective latched and unlatched positions, and means for mounting said latching lever to said retainer along point of inflection, said mounting means including a clip, said latching lever including an opening formed thereon along said inflection point, said latching lever having a bearing surface that contacts said retainer along said inflection point such that said latching lever is movable between first and second operative positions where said latching lever is respectively latched and unlatched to said backplane connector.

9. The connector assembly of claim 8, wherein said clip extends through said lever opening and into engagement with said retainer member.

10. The connector assembly of claim 9, wherein said clip includes a pin member that extends transversely with respect to said latching lever, and said latching lever includes a depression that receives said pin member.

11. The connector assembly of claim 8, wherein said latching lever includes a member for biasing said latching lever into said first operative position.

12. The connector assembly of claim 11, wherein said biasing member includes a leg portion extending from said lever body portion and into contact with said retainer member.

13. A latching assembly for latching a plurality of connectors to a backplane connector in mating engagement therewith, the assembly comprising:

a stiffener member for engaging said plurality of connectors and retaining said plurality of connectors together as a block;

a latching lever for latching said block of connectors to said backplane connector in mating engagement therewith, the latching lever being movable between first and second operative positions;

an attachment member for movably attaching said latching lever to said stiffener member;

said latching lever having an elongated body portion extending between first and second opposing ends, said first end having an engagement hook disposed thereon for engaging a portion of said backplane connector and said second end having a gripping portion for manipulation by a user, said latching lever further having a biasing member that extends therefrom and into contact with said stiffener member to bias said latching lever into said first operative positions wherein said latching lever first end is engaged with said backplane connector to thereby latch said connector block in place in engagement with said backplane connector.

* * * * *